US006142703A

United States Patent [19]

Wilmot et al.

[11] Patent Number: 6,142,703

[45] Date of Patent: Nov. 7, 2000

[54] ENCAPSULATED TURF MAINTENANCE SYSTEM

[76] Inventors: Charles Wilmot, 103 Hillcrest Rd., Needham, Mass. 02492; Anthony P. Nickinello, Jr., 4960 Almaden Expressway, #302, San Jose, Calif. 95118; William Ormsby, 109 Old Farm Rd., Centerville, Mass. 02632

[21] Appl. No.: 09/259,614

[22] Filed: Mar. 1, 1999

[51] Int. Cl.[7] ..... E02B 11/00; E02B 13/00

[52] U.S. Cl. ..... 405/43; 47/48.5; 405/36; 405/37; 405/45; 239/145

[58] Field of Search ..... 405/36, 37, 52, 405/43–45; 239/145; 264/45.9, 45.3, 41; 138/123; 47/58, 48.5

[56] References Cited

U.S. PATENT DOCUMENTS

| | | | |
|---|---|---|---|
| 1,483,689 | 2/1924 | Smith | 405/45 X |
| 2,807,505 | 9/1957 | Weitzel | 405/45 X |
| 3,784,357 | 1/1974 | Muraoka | 239/54 |
| 3,908,385 | 9/1975 | Daniel et al. | 405/37 |
| 3,936,380 | 2/1976 | Boske | 405/45 X |
| 4,003,408 | 1/1977 | Turner | 405/43 X |
| 4,023,506 | 5/1977 | Robey | 47/56 |
| 4,110,420 | 8/1978 | Turner | 264/41 |
| 4,235,561 | 11/1980 | Peterson | 47/48.5 X |
| 4,268,993 | 5/1981 | Cunningham | 405/37 X |
| 4,517,316 | 5/1985 | Mason | 405/43 X |
| 4,615,642 | 10/1986 | Mason | 264/41 X |
| 4,958,770 | 9/1990 | Mitchell | 239/145 |
| 5,152,634 | 10/1992 | Maso | 405/45 |
| 5,306,317 | 4/1994 | Yoshizaki | 405/43 X |
| 5,474,398 | 12/1995 | Prassas et al. | 405/45 |
| 5,944,444 | 8/1999 | Motz et al. | 405/37 |

*Primary Examiner*—Dennis L. Taylor
*Attorney, Agent, or Firm*—Thomas A. Kahrl, Esq.

[57] ABSTRACT

An underground fluid exchange system for control of delivery of fertilization, irrigation and pesticides to and removal from a selected fully encapsulated the turf area of a playing field, including golf course green, having a selected soil profile including a combination turf and topsoil turf segment, a porous soil segment and an impervious soil segment wherein the fluid exchange system comprises a bi-flow porous conduit having uniform porosity that has a selectable exchange rate.

5 Claims, 4 Drawing Sheets

ENCAPSULATED TURF MAINTENANCE SYSTEM

BACKGROUND OF THE INVENTION

1. Field of the Invention (Technical Field)

The present invention relates to an underground fluid exchange system. In particular the invention is directed to a fluid exchange system to control delivery of fertilization, irrigation and pesticides to, and removal from, an encapsulated turf area of a playing field for increasing maintenance efficiency.

The following is an example of turf maintenance programs and their environmental impact profile. Golf courses typically are actively maintained through daily inputs of fertilization, irrigation and pesticides in amounts that exceed the typical home lawn treatment. In particular golf greens typically require the maximum degree of inputs of maintenance effort and resources to the extent the level of input has become an environmental concern. This concern is directed to the degree of risk of contaminating surface or ground waters. This concern has led to conducting long term studies by the USGA including a so-called Cape Cod project that have demonstrated that golf courses can utilize chemicals and fertilizers effectively without contaminating ground or surface waters if proper prescribed procedures are followed. A case in point, when Integrated Pest Management (IPM) procedures are followed the potential for environmental contamination is virtually eliminated notwithstanding daily inputs of fertilization, irrigation and pesticides. All new golf course construction in Massachusetts requires a commitment to follow IPM procedures for golf course management.

Accordingly there is a need to address the issue of reducing fertilizer, irrigation water and pesticide input, as well as, provide protection against contamination of surface and ground waters. This is particularly true with respect to golf greens, as well as other athletic playing fields.

2. Background Prior Art

In the past, attempts have been made to provide disposal arrangements for drainage of athletic playing fields. Applicant is aware of prior art turf maintenance devices, for example U.S. Pat. No. 3,908,385 to Purdue Research Foundation. The Purdue patent that shows a drainage system for rapid drainage of an athletic playing field having a drainage pipe combination adapted for vacuum pumping, but does not address the issue of reducing fertilizer, irrigation water and pesticide input as well as provide protection against contamination of surface and ground waters.

Accordingly, there is a need in the turf art to address the issue of reducing fertilizer, irrigation water and pesticide input with respect to golf greens, as well as other athletic playing fields, which overcome at least some of the disadvantages of prior art.

The present invention overcomes the limitations of the prior technology expressed above by providing an arrangement for encapsulating intensely managed turf areas, such as golf courses and athletic playing fields. Furthermore, the present invention totally restricts any leaching or movement of chemicals into ground waters, and directs all irrigation waters, fertilizer and pesticides by means of bi-flow conduit to a reservoir for recycling.

SUMMARY OF THE INVENTION

The present invention is directed to an underground fluid exchange system for control of delivery of fertilization, irrigation and pesticides to and removal from a selected fully encapsulated the turf area of a playing field. More specifically the preferred embodiment is directed to an encapsulated playing field consisting of a golf course green, having a selected soil profile. The soil profile comprises a combination turf and topsoil turf segment, a porous soil segment and an impervious soil segment wherein the fluid exchange system comprises a bi-flow porous conduit having uniform porosity that has a selectable exchange rate.

Golf course greens are typically constructed to maintain maximum infiltration and percolation of water through rooting media. Root zone mixture composition recommended by the United States Golf Associate (USGA) generally includes at least 90% of sand by weight. This mixture allows for rapid water percolation but has an extremely low cation exchange capacity. These characteristics create a condition for potential movement and leaching of pesticides and nitrate to groundwater and may also cause surface water contamination.

The present invention provides an enhanced environmental approach to golf greens construction by providing an encapsulation means for enclosing the entire golf green profile, including fluid exchange conduit for bi-directional sub-irrigation as well as drainage as required. The encapsulation means comprises an impermeable geo-fabric constructed to restrict any movement of water or dissolved materials from an underlying water table. The geo-fabric is positioned underground beneath the playing field, for eliminating the possibility of any materials leaching into surface or ground waters, with the result that the geo-fabric restricts any contamination of ground waters and surface waters adjacent the playing field.

In the present invention, the fluid exchange apparatus comprising porous conduit positioned underground in a porous soil segment provides for controlling the transfer of chemical laden water between a turf and soil profile and a containment reservoir. Said conduit comprising a combination of activated charcoal and portland cement that can be selectively formed to yield a wide range of porosity, which is uniform in porosity through the length of the conduit. In the preferred embodiment the porosity-water flow is 5.0 gal/min. Due to the nature of the conduit, it acts as a gravity fed drainage as well as a sub-irrigation supply source, providing bi-directional movement of fluid. The nature of the walls of the conduit provides for filtration and eliminates fouling of the conduit by preventing soil fines entering and clogging the conduit. The porous conduit is positioned underground in the porous soil segment below the turf root zone, for controlling the transfer of fluids between the solid profile and the reservoir. This conduit also contains a continuous filter wall for selectively receiving filtered drainage fluid by gravity. Also, responsive to recycling pumping action, the conduit provides filtered subsurface irrigation to the root zone of the turf.

A manifold is provided for connecting the porous conduit to the reservoir, which includes a pump means for transferring fluid from reservoir means to root zone of turf for improved root zone management. The reservoir means for receiving and storing all fluids introduced to the soil profile; for later transfer by said pump means to the root zone as required. Conventional Sensing and fluid control means, well known in the art, are employed to regulate the direction and rate of flow of water in the system.

The present invention is particularly directed to providing an efficient means of implementing Integrated Pest Management (IPM) procedures for golf course greens management to eliminate the potential for environmental contamination notwithstanding daily inputs of fertilization, irrigation and pesticides.

It is a general object of the present invention to provide a self-contained reservoir system for recycling irrigation water for reducing use of pesticides and providing improved root management of an athletic turf system.

Another object of the invention is to provide a scheduling means for adjusting irrigation and fertilization to eliminate adverse impacts on the environment adjacent the golf green.

Yet another object of the present invention to increase the efficiency of managing water for irrigation and fertilizer supply to a USGA Golf Putting Green to maintain the health of the green.

A further object of the invention is to provide an efficient recycling of water and nutrients while totally restricting movement of materials to groundwater.

These and other objects, advantages, and features of the invention will be apparent from the following description of preferred embodiments considered along with the accompanying drawings. The invention will be described for the purposes of illustration only in connection with certain embodiments; however, it is recognized that those persons skilled in the art may make various changes, modifications, improvements and additions on the illustrated embodiments all without departing from the spirit and scope of the invention.

BRIEF DESCRIPTION OF THE DRAWINGS

The accompanying drawings, which are incorporated into and form a part of the specification, illustrate several embodiments of the present invention and together with the description serve to explain the principals of the invention. The drawings are only for the purpose of illustrating a preferred embodiment of the invention and are not construed as limiting the invention

DETAILED DESCRIPTION OF THE PREFERRED EMBODIMENT

Figure 1:
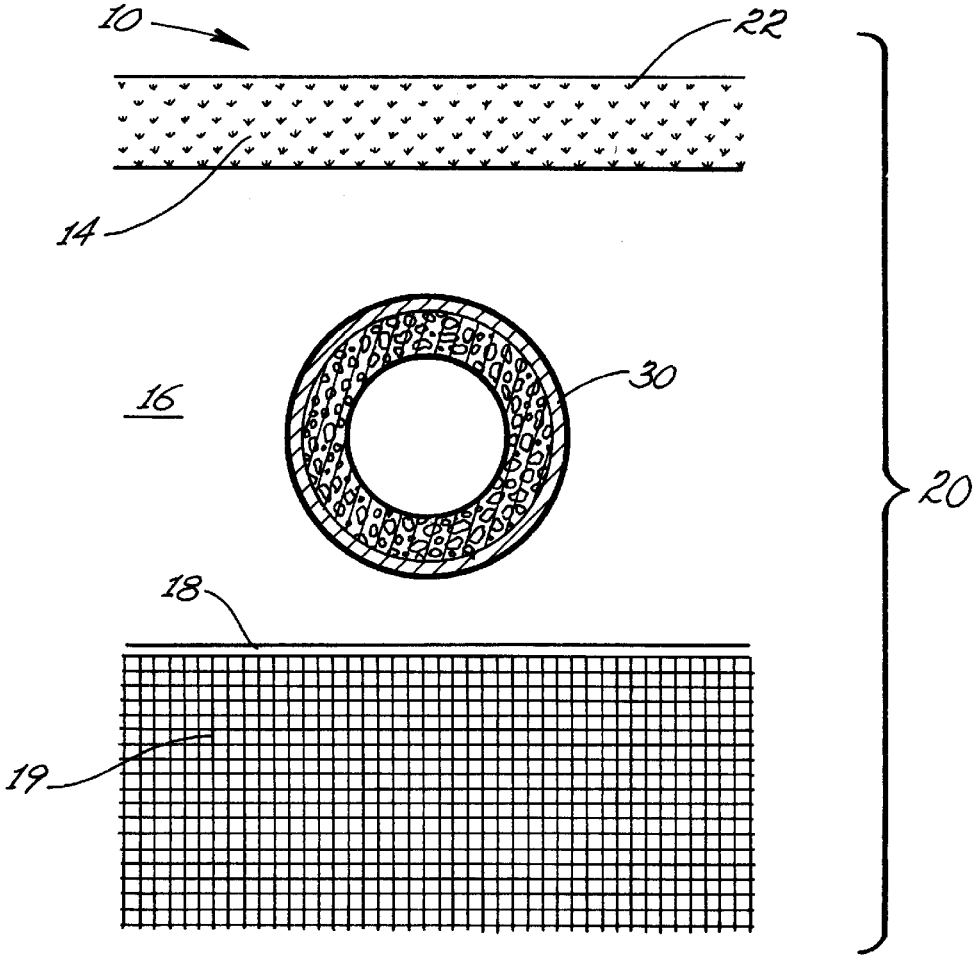
FIG. 1 is schematic layout of the encapsulated turf maintenance system, "WIFS," showing a cross sectional view at the drainage field of the present invention

Referring to the FIGS. 1–4, the preferred embodiment is directed to the inventive combination of a playing field 10 having a selected soil profile 12 and a fluid exchange system 20 comprising a combination turf and topsoil turf segment 14, a porous soil segment 16, impervious liner 18 and an impervious soil segment 19.

Figure 5:
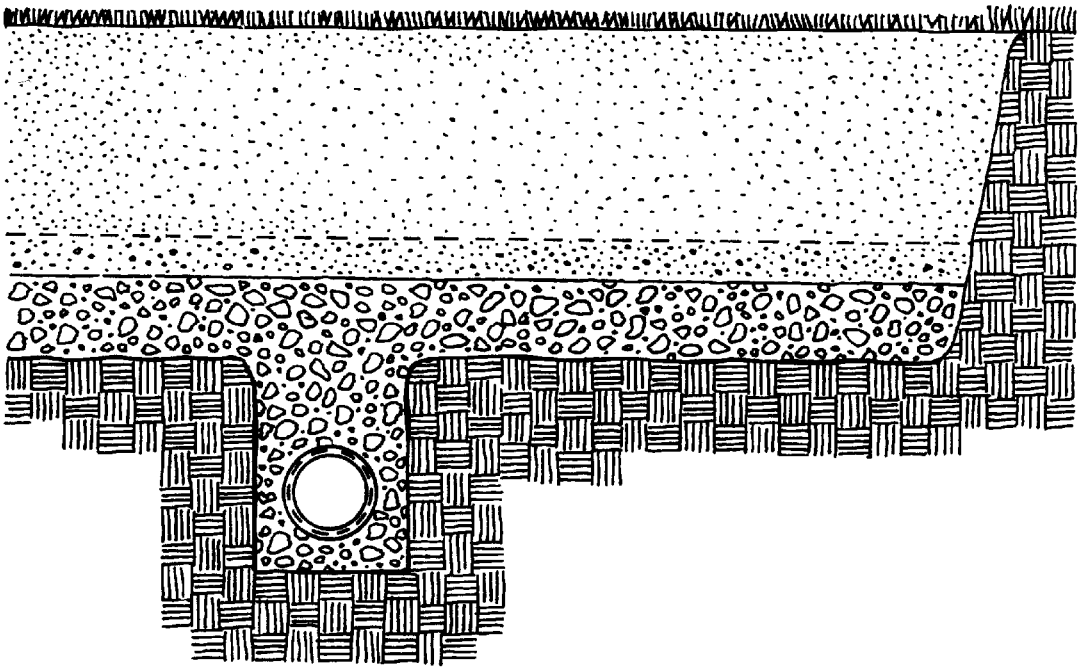
FIG. 5 is the standard profile of the United States Golf Association golf green that consists of three layers: root zone; coarse sand layer; and coarse stone drain layer.

For comparison purposes, there is shown in FIG. 5 the standard profile of the United States Golf Association golf green that consists of three layers: root zone; coarse sand layer; and coarse stone drain layer. The root zone soil is composed of 80% fine sand and 20% peat organic material. The particle density of the root zone is 2.42 g/cm $^3$; bulk density is 1.65 g/cm$^3$; total porosity is 31.67; airfilled porosity was 26.64%; and infiltration rate is 44.71 inch/hr. As is shown in FIG. 1, a 4" perforated drain is provided in washed stone positioned below the washed stone blanket.

Referring to FIGS. 1–4 there is shown schematic layouts of the fluid exchange system 20, "WIFS", showing a cross sectional view at a drainage field 22, the irrigation/drainage apparatus 24 of a selected playing field 10 and a reservoir 26. As is shown in FIG. 1, fluid exchange system 20, "WIFS" shows four layers comprising a layer of topsoil and grass by "others" 14, porous soil layer 16, approximately 10" thick, wherein a 6" diameter Wilform Porous Conduit 30, having a 1" filter wall 32 is disposed; a layer of impervious liner 18 comprising an impermeable geo-fabric providing an encapsulation barrier; and a layer of impervious soil 19 compacted to an approximate depth of 6."

Figure 2:
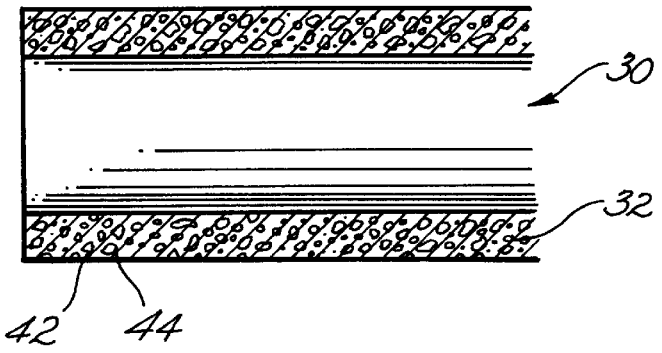
FIG. 2 is a central longitudinal view of the porous conduit of the invention of FIG. 2.

Referring to FIG. 2 there is shown central longitudinal view of a section of porous conduit 30 positioned underground in the porous soil segment 16. Conduit 30 provides a means for controlling the transfer of water 40, shown in FIG. 4 between said turf and soil profile and a containment reservoir 42. As is shown in FIG. 2, conduit 30 comprises a combination of activated charcoal 42 and portland cement 44 which can be selectively formed to yield a wide range of porosity. In the preferred embodiment the porosity-water flow is 5.0 gal/min. Due to the nature of conduit 30, it acts as both a gravity fed drainage from the turf and soil profile and subirrigation supply source, providing bi-directional movement of water 40. The nature of the filter wall 32 of conduit 30 provides for filtration and eliminates fouling of the conduit 30 by preventing soil fines entering and clogging said conduit.

Figure 3:
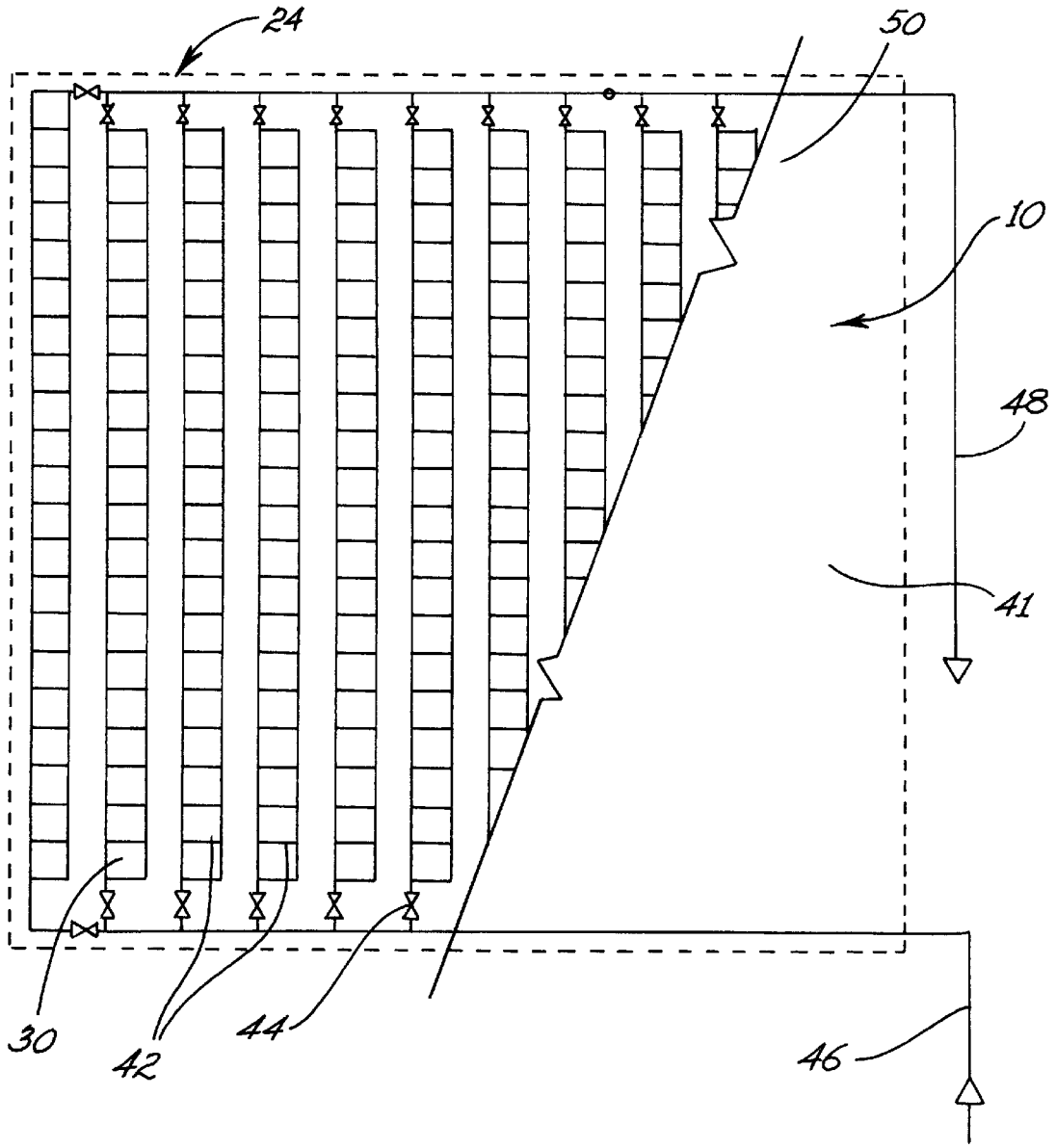
FIG. 3 is a top schematic view of a irrigation and rainage area of the present invention showing the layout of conduit shown as piping with control valves.
Figure 4:
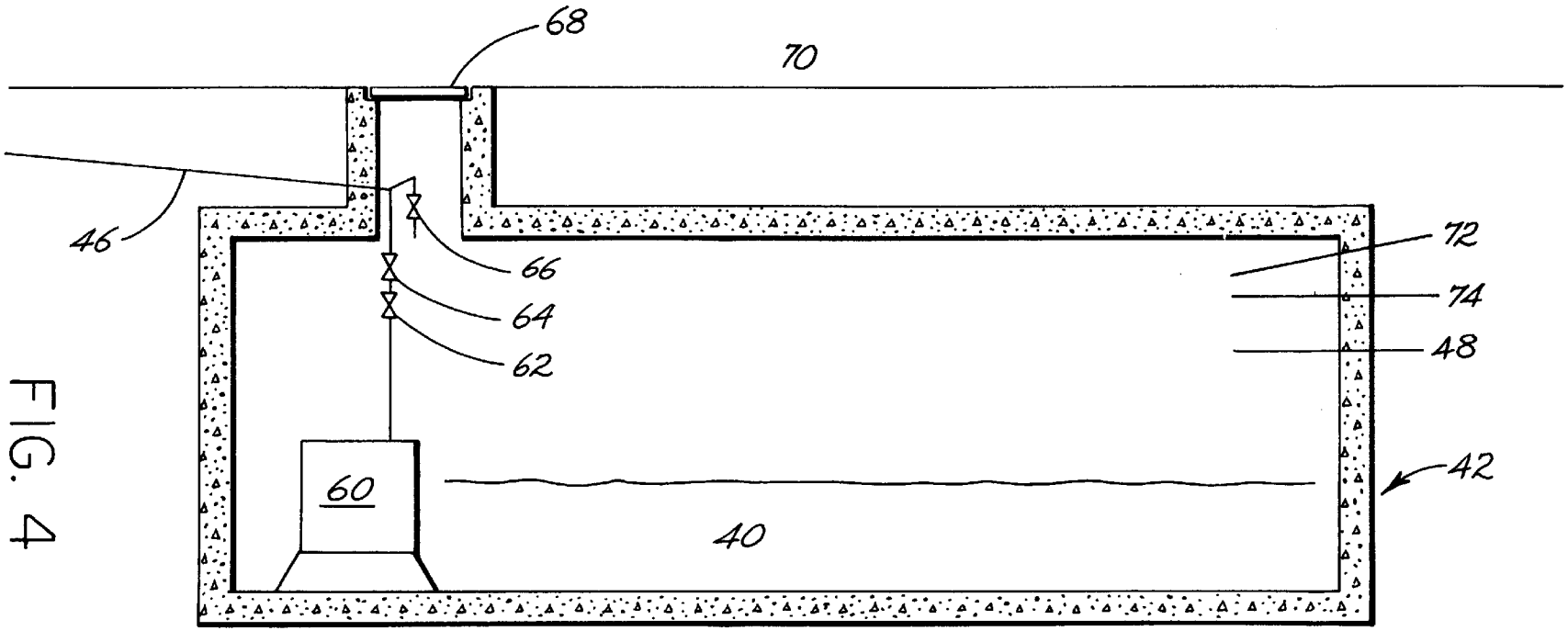
FIG. 4 is a cross section of the reservoir shown as a 1500 gallon concrete holding tank with supply piping to drainage area of FIG. 4 and return piping from said drainage area.

Referring to FIG. 3 there is shown a top schematic view of an irrigation/drainage area 41 showing the layout of conduit 30 shown as a plurality of rows piping 42 on 20" centers connected to control valves 44 and in turn to supply 46 and return 48 lines 46 comprising solid piping which are connected to the reservoir 26 as is shown in FIG. 4. Tensiometers 50 are selectably located in said irrigation/drainage area Referring to FIG. 4 there is shown a sectional schematic of the containment reservoir 42 shown as a holding tank showing supply lines 46 to irrigation/drainage area 41 and return lines 48 therefrom. Also shown is a pump 60 shown successively in communication with check valve 62, automatic shut-off valve 64 automatic drain valve 66 and supply piping 46. An access man hole 68 is shown adjacent finish grade 70. Also shown is a tank make-up line with sensor 72, tank overflow line with sensor 74 and return piping 48 from irrigation/drainage area.

What is claimed is:

1. An underground fluid exchange system for control of delivery to and removal from the turf area of a playing field comprising:

a) a playing field having a selected soil profile comprising a combination turf and topsoil turf segment, a porous soil segment and an impervious soil segment;

b) fluid exchange apparatus positioned underground in the porous soil segment for controlling the transfer of fluids between the solid profile and a reservoir comprising soil-embedded porous conduit comprising a continuous filter wall for selectively receiving filtered drainage fluid and filtered subsurface irrigation;

c) reservoir means for receiving and storing all fluids introduced to the soil profile;

e) manifold means for connecting the porous conduit to said reservoir f) pump means for transferring fluid form reservoir means to soil profile of turf b) an encapsulation means for enclosing the soil profile positioned underground beneath the playing field;

g) control means with sensing means for controlling transfer of chemical laden water between a turf and soil profile and a containment reservoir wherein said fluid exchange system restricts any "leaching" or movement of chemicals into ground waters and directs all irrigation waters, fertilizer and pesticides into a holding tank for recycling.

2. The fluid exchange system claim 1 wherein the encapsulation means restricts any contamination of ground waters and surface waters adjacent the playing field.

3. The fluid exchange system claim 1 wherein the system restricts any "leaching" or movement of chemicals into ground waters and directs all irrigation waters, fertilizer and pesticides into a holding tank for recycling.

4. The fluid exchange system claim 1 wherein the porous conduit comprises a combination of activated charcoal and portland cement which can be selectively formed to yield a wide range of porosity and includes a filter wall for filtration.

5. The fluid exchange system claim 4 wherein the porous conduit acts both as a gravity fed drainage from the turf and soil profile and subirrigation supply source by providing bi-directional movement of water.

* * * * *